United States Patent [19]

Drapeau

[11] Patent Number: 4,626,819

[45] Date of Patent: Dec. 2, 1986

[54] SWITCH ADJUSTING MECHANISM

[75] Inventor: Donald F. Drapeau, Windsor, Conn.

[73] Assignee: Safeway Products, Inc., Middletown, Conn.

[21] Appl. No.: 724,190

[22] Filed: Apr. 17, 1985

[51] Int. Cl.[4] ..... H01H 37/36

[52] U.S. Cl. ..... 337/323; 200/835; 337/319

[58] Field of Search ..... 337/323, 319, 347, 349, 337/368; 200/835

[56] References Cited

U.S. PATENT DOCUMENTS

| | | | |
|---|---|---|---|
| 1,972,739 | 9/1934 | Kahn . | |
| 2,635,157 | 4/1953 | Flight et al. . | |
| 2,812,404 | 11/1957 | Alcott | 337/323 |
| 3,348,009 | 10/1967 | Staples . | |
| 3,382,337 | 5/1968 | Larssen . | |
| 3,409,758 | 11/1968 | Hild et al. . | |
| 3,568,123 | 3/1971 | Wolfe et al. . | |
| 3,668,592 | 6/1972 | Decker . | |
| 3,831,127 | 8/1974 | Purssell . | |
| 4,038,613 | 7/1977 | Fischer . | |
| 4,160,225 | 7/1979 | Durst . | |

*Primary Examiner*—Harold Broome

*Attorney, Agent, or Firm*—Hayes & Reinsmith

[57] ABSTRACT

A switch adjusting mechanism is disclosed having a linearly operable actuator with a rotary adjustment for selectively varying the position of a switch operator of the actuator relative to a movable switch contact. The linearly operable actuator and its rotary adjustment are independently operable and serve dual functions of not only accurately adjusting the operating point of switch actuation but also providing precise facile calibration.

10 Claims, 2 Drawing Figures

SWITCH ADJUSTING MECHANISM

FIELD OF THE INVENTION

This invention generally relates to switch adjusting mechanisms and is particularly directed to such mechanisms for use in both calibrating and adjusting the operating point of electrical switches.

BACKGROUND OF THE INVENTION

Standard purchased switches, such as snap action contact switches, microswitches and the like, are used in a variety of different applications for controlling pressure, velocity, temperature, etc. Such switches, which may be made to identical specifications for a particular application, are commonly found to vary significantly in operating forces required for switch actuation, while also being difficult and expensive to calibrate. In short, such switches frequently provide unacceptable variations in actual practice.

In a particular application, such as in controlling temperature of a waterbed, e.g., variations in accuracy of temperature adjustment encountered with standard switches typically have been ±7°-10° F. Such variations for a temperature controller are unacceptable, and this exemplifies the problem which is equally applicable to other types of mechanisms for different types of functions to be controlled.

Accordingly, it is an object of this invention to provide a new and improved switch adjusting mechanism of a significantly simplified design requiring a minimum number of different parts specifically designed for low cost and easy manufacture and assembly. A related aim of this invention is to achieve the further objectives of providing such a mechanism which readily and accurately adjusts the operating point of its associated switch in addition to effecting quick and easy calibration with precision.

SUMMARY OF THE INVENTION

The mechanism of this invention features an actuator which has a switch operator and both a linear drive member and a rotary drive member which independently control the effective positioning of the switch operator and its engagement with a movable switch contact. The rotary drive member is in threaded engagement with the linear drive member and is supported on that linear drive member for rotation. The linear drive member is fixed against rotation and is supported for reciprocation toward and away from the movable contact by operation of a condition sensing means for selectively varying the position of the switch operator relative to the movable contact. Such action controls the desired operating point at which the switch is actuated to energize or de-energize an associated electrical circuit. In addition, a manual adjustment knob is drivingly connected to the rotary drive member of the actuator for selectively varying the position of the switch operator relative to the movable contact. A mechanism featuring such construction serves dual functions of providing quick, easy and precise calibration of the switch and also accurately adjusting its operating point.

Other objects will be in part obvious and in part pointed out in more detail hereinafter.

A better understanding of the objects, advantages, features, properties and relations of the invention will be obtained from the following detailed description and accompanying drawings which set forth certain illustrative embodiments and are indicative of the various ways in which the principles of the invention are employed.

DESCRIPTION OF THE PREFERRED EMBODIMENTS

Figure 1:
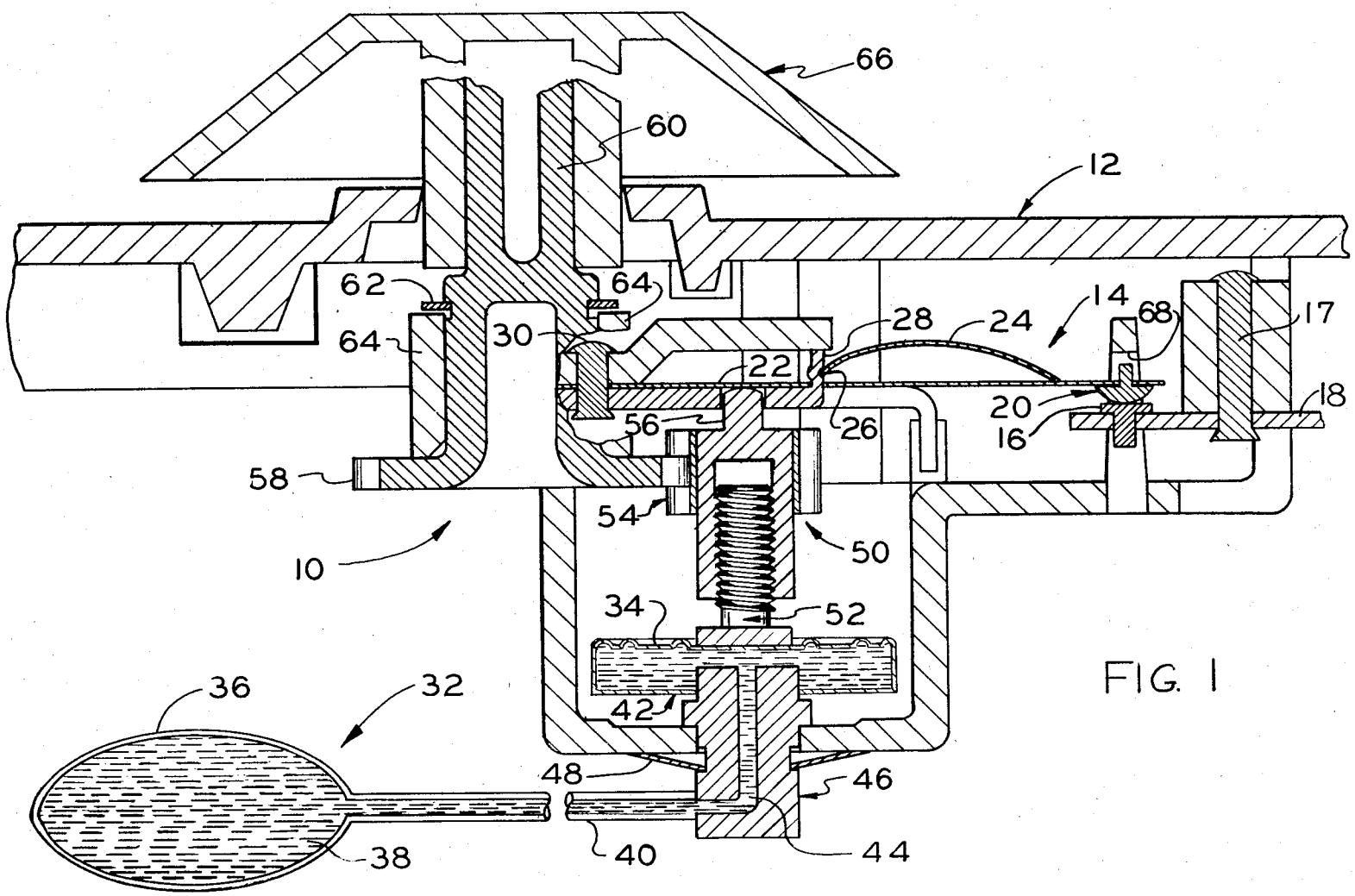
FIG. 1 is a side view, partly broken away and partly in section, showing a switch adjusting mechanism of this invention.

Referring now to the drawings in detail, a condition responsive switch adjusting mechanism 10 of this invention is mounted in a housing 12 for controlling switch operation responsive to a given condition. The mechanism 10 of this invention will be understood to be useful in controlling different conditions, such as velocity, pressure and temperature, for example, in specific applications which may utilize a variety of switches, such as microswitches or over-center snap action contact switches, for controlling energization and de-energization of an associated electrical circuit, not shown.

In the illustrated embodiment, the application of this invention is specifically directed to a temperature controller, for example, in controlling temperature of water in a waterbed by means of a heater, not shown, energized and de-energized by an electrical circuit, not shown, controlled by a switch 14 having a stationary contact 16 fixed by rivet 17 to a housing support 18. A movable contact 20 is supported for movement between its normally closed switch position, illustrated in FIG. 1, and an open switch position. Contact 20 is a standard over-center snap action movable contact shown cooperating with fixed contact 16, and the movable contact 20 includes a contact arm 22 having an integral over-center spring 24 preloaded into a spring notch 26 formed in a movable contact arm support 28. The movable contact arm support 28 and the movable contact arm 22 are mounted within housing 12 by any means such as the illustrated rivet 30.

A condition sensing means 32 is mounted on housing 12 in underlying relation to movable contact 20. In the specifically illustrated embodiment, the condition sensing means is a temperature-operated control device having an output portion or diaphragm 34 movable in response to the condition sensed, namely, change in temperature levels. In this illustrated embodiment, a bulb 36, preferably metallic, is shown filled with a temperature sensitive expansible matter, such as glycol 38.

As is well known in the art, a rise in ambient temperature (such as water contained within a waterbed) causes glycol 38 within bulb 36 to expand. This volumetric expansion is transmitted through a capillary tube 40 into casing 42 to move its diaphragm 34, forming an end wall on casing. Upon such expansion, diaphragm 34 moves upwardly from its illustrated retracted position (as viewed in FIG. 1) in response to increases in temperature. Other suitable liquids, with predictable thermal expansion characteristics, may be used to effect the described expansion and contraction in response to increases and decreases in temperature to drive diaphragm 34 of the described bulb and capillary control device which in effect serves as a thermal power unit. Upon cooling, the glycol 38 will be understood to contract, the diaphragm 34 will return from its extended position to its illustrated retracted position by virtue of its resilient form-sustaining construction. In the embodiment shown, capillary tube 40 is preferably formed of metal and is suitably secured, such as by welding, to an inlet of a passage 44 extending through mounting block 46 shown supported on housing 12 and fixed in position by retaining ring 48. An outlet of mounting block passage 44 communicates with chamber of casing 42 which in turn is supported in fluid tight relation on mounting block 46.

To operate movable contact 20 in accordance with this invention, a switch actuator 50 is disposed between movable contact 20 and output portion 34 of the condition sensing means 32. More specifically, actuator 50 includes a first member or stud 52 suitably fixed such as by welding to a central portion of diaphragm 34 such that stud 52 effects an axial reciprocating travel toward and away from movable contact 20 in synchronism with expanding and contracting movements of diaphragm 34.

In accordance with yet another feature of this invention, the switch actuator 50 also includes a rotary second member or drive pinion 54 threadably engaged with stud 52. Pinion 54 is shown having an integral central projection 56 extending in coaxial alignment with both pinion 54 and stud 52. Projection 56 serves as a switch operator and is enagageable with movable contact 20. To selectively adjust the angular position of drive pinion 54 to control movement of movable contact 20 responsive to movement of diaphragm 34 of the thermal power unit, an adjustment gear 58 is shown mounted of an end of an adjustment shaft 60 with adjustment gear 58 in mesh with drive pinion 54 of actuator 50. Adjustment shaft 60 is shown assembled within housing 12 and maintained in place by a retaining ring 62 for rotary movement within a bearing sleeve 64 which will be understood to be in fixed relation to housing 12. For rotating adjustment gear 58, and thus changing the angular position of drive pinion 54, and adjustment knob 66 is provided.

By virtue of the above described construction, a particularly compact mechanism 10 is provided featuring a linearly operable actuator 50 having a rotary adjustment for controlling movement of movable contact 20. The disclosed simplified and low cost gear train and its adjustment knob 66 may each be formed of injection molded plastic parts which are easily assembled for extended service use and reliable performance, in addition to ease and accuracy of calibration.

To effect calibration, bulb 36 is immersed for a selected period of time in a setting tank, not shown, maintained at a selected calibration temperature of, say, 100° F. Adjustment gear 58 then may be rotated until the switch 14 is actuated. I.e., as drive pinion 54 rotates in a given angular direction, it also moves in a linear direction extending axially of stud 52 with which it is threadably engaged. Accordingly, adjustment gear 58 is rotated through an angular displacement to create sufficient torque on movable contact arm 22 to overcome the preload torque of its over-center spring 24 and thereby force movable contact 20 to separate from stationary contact 16 and to bottom on post 68 with a snap action movement of movable arm 22. The adjustment knob 66 is then fixed in any suitable manner to shaft 60 of adjustment gear 58 with indicia, not shown, on knob 66 aligned with a fixed reference pointer, not shown, on housing 12 to show the preselected calibration temperature of 100° F.

After calibration is achieved, selection of a desired temperature at which the switch 14 is to be actuated to energize or de-energize the waterbed heater or other device requires rotation of adjustment knob 66 to a desired temperature as shown by indicia on knob 66 relative to the fixed reference pointer. Through the simplified gearing disclosed, the position of the adjustment pinion 54 (including its projection 56 comprising the switch operator) is adjusted, and the threaded connection between adjustment pinion 54 and stud 52 causes pinion 54 to advance or retract thereon in accordance with angular movements in opposite directions so as to adjustably position the switch operator 56 that engages movable contact 20. Thereafter, when the sensed temperature increases and glycol 38 expands to drive diaphragm 34 and stud 52 toward the movable contact arm 22, such movement will cause movable contact 20 to open the electrical circuit as described above. When the sensed temperature decreases and glycol 38 contracts, the torque imposed by the switch operator 56 of drive pinion 54 on the movable contact arm 22 is reduced. Once this torque is sufficiently reduced, the over-center spring 24 drives movable contact 20 toward stationary contact 16 until the contacts re-engage and close the electrical circuit.

Figure 2:
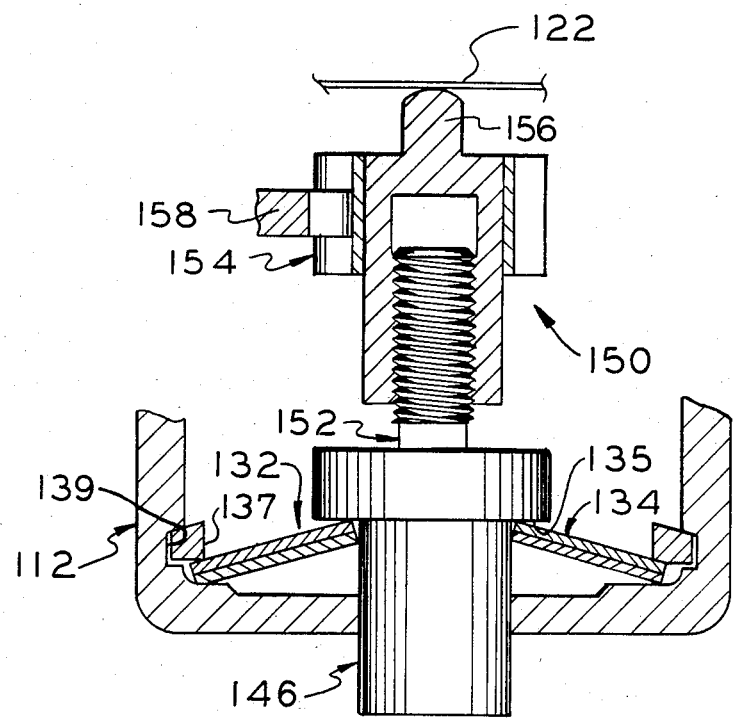
FIG. 2 is a side view, partly broken away and partly in section, showing another embodiment of the mechanism of this invention.

In the embodiment illustrated in FIG. 2, a switch operator 156 is again illustrated as a projection on drive pinion 154 which meshingly engages an adjustment gear 158. The drive pinion 154 comprises a rotary drive component of an actuator 150. The linear drive component of that actuator 150 is illustrated as threaded stud 152 which will be understood to be fixed to a mounting block 146 supported for reciprocable movement within housing 112. However, in this particular embodiment, the thermal power unit 132 comprises a bimetallic disc 134 which is shown mounted between housing 112 and a shoulder 135 on block. It is to be understood that disc 134 is spring loaded and is mounted in a spring loaded condition by a retaining ring 137 fitted within an internal groove 139 in housing 112 with ring 137 engaging an outer diameter portion of the bimetallic disc 134.

Accordingly, upon sensing an increase in temperature, bimetallic disc 134 expands and drives stud 152 toward movable contact arm 122. Upon sensing a decrease in temperature, bimetallic disc contracts and drives stud 152 away from the movable contact arm 122. All other functions, including calibration and adjustment of the switch operating point are the same as in the first described embodiment.

The mechanism of this invention has been found to provide temperature adjustment to an accuracy of ±0.25° F.

As will be apparent to persons skilled in the art, various modifications, adaptations and variations of the foregoing specific disclosure can be made without departing from the teachings of this invention.

I claim:

1. A condition responsive switch adjusting mechanism comprising switch contact means including a snap action movable contact, condition sensing means including an output portion movable in response to a sensed condition, an adjustable length actuator for the switch contact means disposed between the movable contact and the output portion of the sensing means, the actuator having a first member fixed against rotation and a second pinion member in coaxial alignment and threaded engagement with said first member for rotary and axial movement relative to said first member to adjust the length of said actuator, and an adjustment gear drivingly connected to said second pinion member for selectively adjusting the angular and axial position of the second pinion member relative to the first member.

2. The mechanism of claim 1 further comprising an adjustment knob drivingly connected to the adjustment gear for adjusting its angular position.

3. The mechanism of claim 1 wherein the output portion of the condition sensing means is drivingly connected to said first actuator member, and wherein displacement of the first actuator member in opposite directions responsive to movement of the output portion of the condition sensing means effects closing and opening of the switch contact means.

4. The mechanism of claim 1 wherein the condition sensing means is temperature responsive and its output portion is drivingly connected to said first member for moving said first member in opposite linear directions relative to the movable contact in response respectively to increases and decreases in temperature.

5. The mechanism of claim 1 wherein the condition sensing means is temperature responsive and its output portion comprises a bimetallic element drivingly connected to said first member for moving it in opposite linear directions relative to the movable contact in response respectively to increases and decreases in temperature.

6. The mechanism of claim 1 wherein said first actuator member is supported on said output portion of the condition sensing means for linear reciprocating movement toward and away from the movable contact.

7. The mechanism of claim 6 wherein the actuator further includes a switch operator movable relative to the movable contact responsive both to linear displacement of said first actuator member and to rotation of said second actuator member.

8. The mechanism of claim 7 wherein displacement of said first actuator member in opposite linear directions changes the effective positioning of the switch operator relative to the movable contact.

9. The mechanism of claim 7 wherein the switch operator comprises a projection extending from said second actuator member with the projection being coaxially aligned with said first and second actuator members.

10. The mechanism of claim 1 wherein mounting means supports the movable contact in a first preselected switch position, wherein the condition sensing means includes a thermal power unit, wherein the thermal power unit has a thermally sensitive element comprising said output portion which expands and contracts, respectively, in response to increases and decreases in temperature, and wherein said first actuator member is drivingly connected to the thermal power unit for thermal excursion between a retracted position, wherein the movable contact is in its first preselected switch position, and an extended position wherein the movable contact is moved by said first actuator member into a second switch position.

* * * * *